US008051501B2

(12) United States Patent
Chiang

(10) Patent No.: US 8,051,501 B2
(45) Date of Patent: Nov. 8, 2011

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 303 days.

(21) Appl. No.: 12/458,920

(22) Filed: Jul. 28, 2009

(65) Prior Publication Data

US 2011/0004981 A1 Jan. 13, 2011

(30) Foreign Application Priority Data

Jul. 13, 2009 (TW) ..... 98212750 U

(51) Int. Cl.
*A61F 9/02* (2006.01)

(52) U.S. Cl. ..... 2/426; 2/444

(58) Field of Classification Search ..... 2/426, 428, 2/444–446, 448
See application file for complete search history.

(56) References Cited

U.S. PATENT DOCUMENTS 5,802,621 A * 9/1998 Chou ..... 2/430
2008/0111966 A1* 5/2008 Chiang ..... 351/43
2009/0293181 A1* 12/2009 Chiang ..... 2/428
* cited by examiner

*Primary Examiner* — Katherine Moran
(74) *Attorney, Agent, or Firm* — Rosenberg, Klein & Lee

(57) ABSTRACT

Swimming goggles include a left lens frame, a right lens frame, a connecting member for connecting the left lens frame and the right lens frame, a left connecting frame, a right connecting frame, a left pad frame, a right pad frame and buckles. The left lens frame and the right lens frame have lenses therein. The left connecting frame and the right connecting frame are made of hard material resistable against pulling force from the head strap of swimming goggles, and are respectively assembled to front sides of the left lens frame and the right lens frame. The buckles are unitarily assembled on outward sides of the left connecting frame and the right connecting frame. The left pad frame and the right pad frame are made of material softer than the left connecting frame and the right connecting frame, and cover around a user's eyeholes.

11 Claims, 4 Drawing Sheets

SWIMMING GOGGLES

BACKGROUND OF THE INVENTION

1. Field of the Invention

The present invention relates to swimming goggles, and particularly to swimming goggles which fit to a user's eyeholes closely with low water resistance and is worn comfortably without leakage of water.

2. Related Art

Some swimming goggles are adapted for swim racing, and have frames covering around a user's eyeholes while being worn. The swimming goggles do not project beyond the user's face too much for producing less resistance in the water. This is vital for swim racers who pursues time saving. However, the swimming goggles are generally worn uncomfortably, and take the risk of water leakage. Moreover, the swimming goggles have lenses and frames unitarily formed by rigid material, and no pad is provided on the frames to touch a user's face gently. As a result, the rigid frames touch the user's eyeholes directly. The user may feel uncomfortable around the eyeholes. Water leakage may occur to the user because of incomplete touch of the swimming goggles to the user's eyeholes.

SUMMARY OF THE INVENTION

Accordingly, an object of the present invention is to provide swimming goggles adapted for swim racing, which fit for users' eyeholes closely and comfortably, and prevent against leakage and deformation of frames while adjusting a head strap thereof.

The swimming goggles comprise a left lens frame, a right lens frame, a connecting member, a left connecting frame, a right connecting frame, a left pad frame, a right pad frame and buckles. Each of the left lens frame and the right lens frame has lens therein and defines a ring groove around the lens. Assembling bases are formed on inward sides of the left lens frame and the right lens frame. The connecting member is assembled on the assembling bases of the left lens frame and the right lens frame. The left connecting frame and the right connecting frame are made of hard material resistable against pulling force from the head strap of swimming goggles. Each of the left connecting frame and the right connecting frame forms a first connecting side and a second connecting side. The first connecting sides of the left connecting frame and the right connecting frame are respectively assembled to front sides of the left lens frame and the right lens frame and adjacent to the ring grooves. The left pad frame and the right pad frame are made of material softer than the left connecting frame and the right connecting frame, and cover around a user's eyeholes. Each of the left pad frame and the right pad frame includes an assembling side and a touching side. The assembling sides are assembled with the second connecting sides of the left lens frame and the right lens frame. The buckles are assembled on outward sides of the left connecting frame and the right connecting frame. Each buckle includes a branch and an extending base extending unitarily from the branch. The branches are embedded in the left connecting frame and the right connecting frame.

DESCRIPTION OF THE PREFERRED EMBODIMENTS

Figure 1:
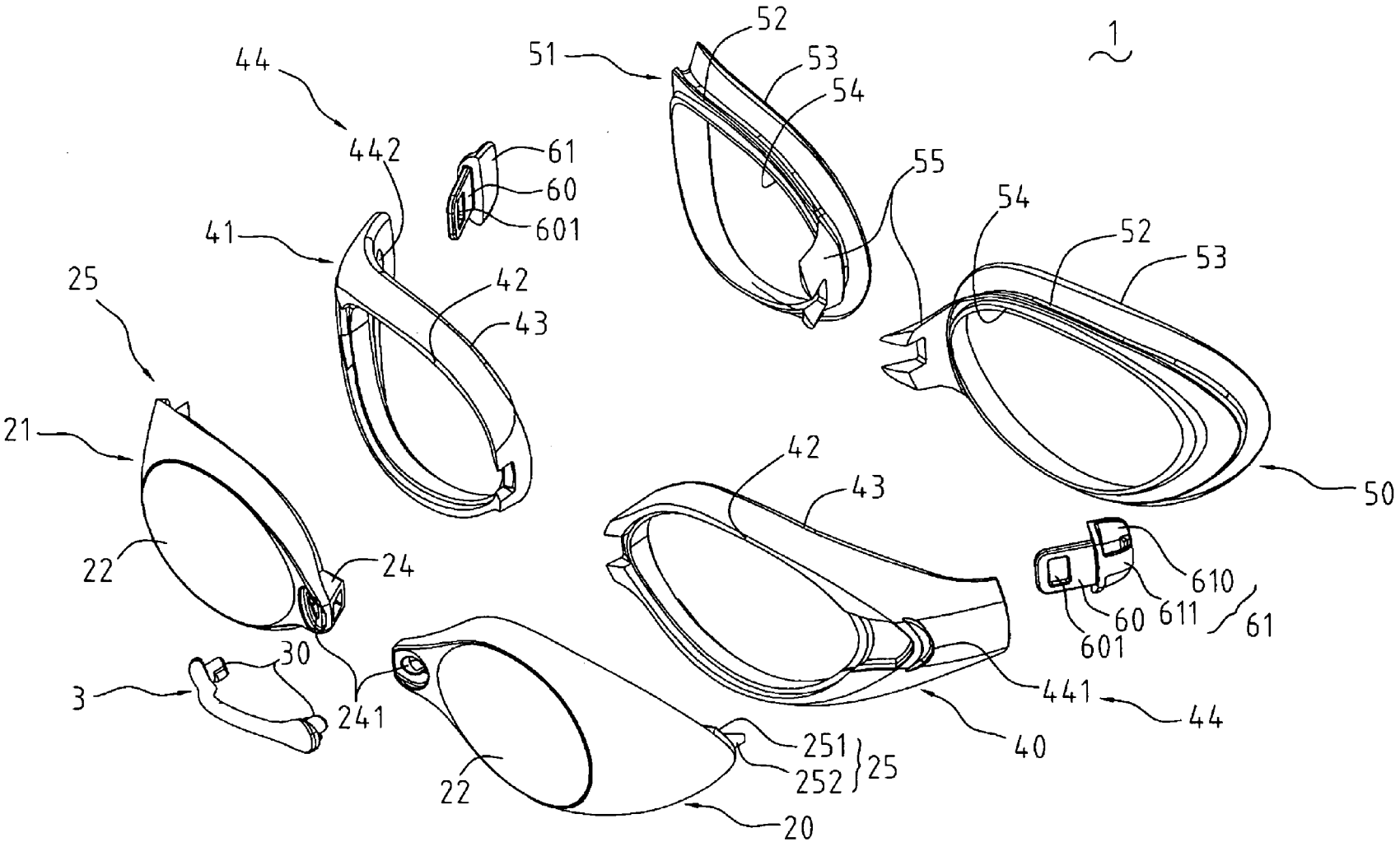
FIG. 1 is an exploded view of swimming goggles according to the present invention.

With reference to FIG. 1, swimming goggles 1 of the present invention is shaped by integral injection, and comprise a left lens frame 20, a right lens frame 21, a connecting member 3, a left connecting frame 40, a right connecting frame 41, a left pad frame 50, a right pad frame 51, and buckles 6. The left lens frame 20 and the right lens frame 21 are made of Polycarbonate (PC). Each of the left lens frame 20 and the right lens frame 21 has lens 22 therein, and defines a ring groove 23 (see FIG. 5) around the lens 22. Assembling bases 24 are formed on inward sides of the left lens frame 20 and the right lens frame 21, and define latch grooves 241 therein. Assembling pegs 25 are formed in the ring grooves. 23 and at outward sides of the left lens frame 20 and the right lens frame 21 opposite to the assembling bases 24 for retaining the left connecting frame 40 and the right connecting frame 41. Each assembling peg 25 includes a base portion 251 and a tail portion 252. Majority of the base portions 251 are integrated with the left lens frame 20 and the right lens frame 21. The tail portion. 252 is shrouded by the left connecting frame 40 and the right connecting frame 41 when assembled.

The connecting member 3 is planar, and is made of Polycarbonate (PC). The connecting member 3 is assembled on the assembling bases 24 for connecting the left lens frame 20 and the right lens frame 21, and forms latch posts 30 thereon for latching the latch grooves 241 of the assembling bases 24.

Figure 4:
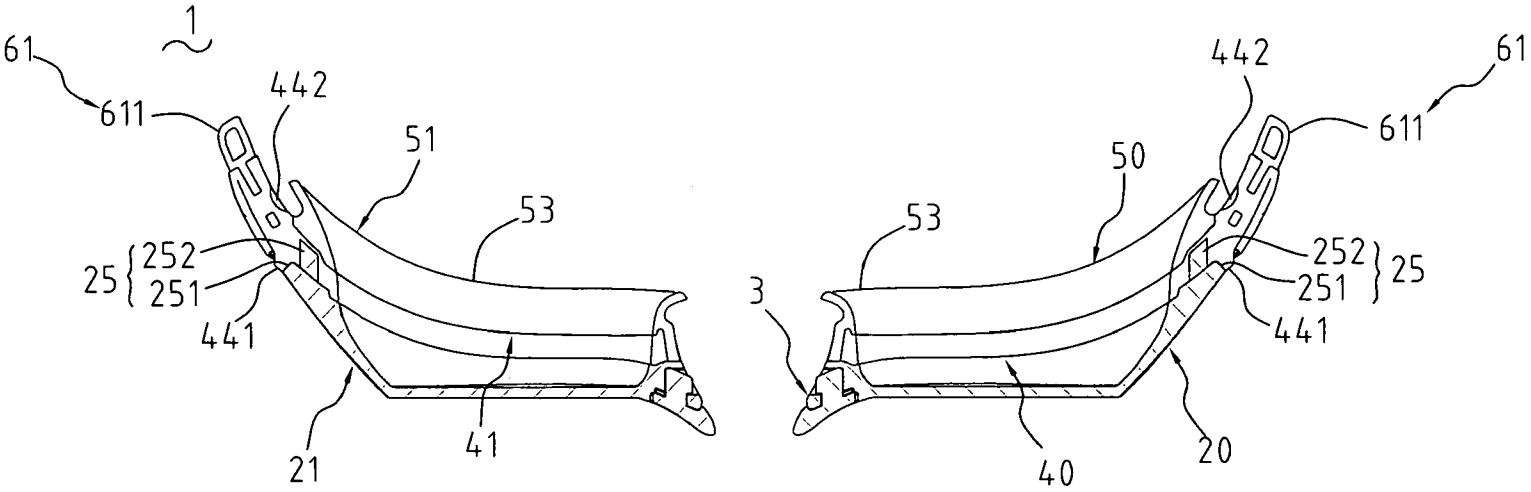
FIG. 4 is a cross-sectional view taken along the line 4-4 in FIG. 3.
Figure 3:
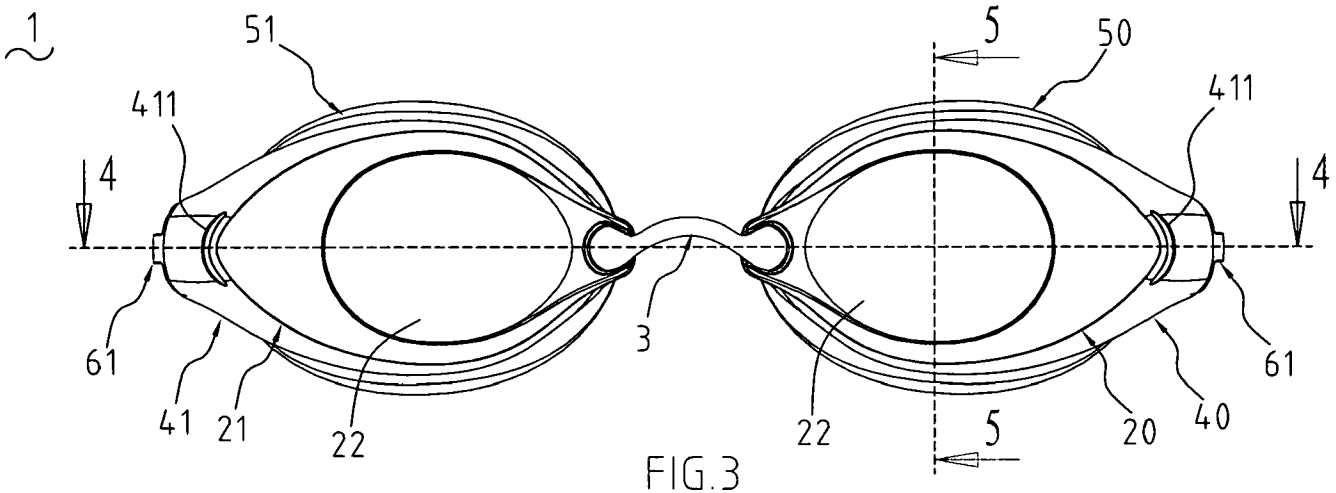
FIG. 3 is a front view of the swimming goggles of FIG. 2.

The left connecting frame 40 and the right connecting frame 41 are both made of Thermoplastic Rubber (TPR), which is featured of injection shaping and gluing, for facilitating assembly with the left lens frame 20 and the right lens frame 21, and for resisting pulling force of a head strap (not shown) of the swimming goggles 1. The left connecting frame 40 and the right connecting frame 41 respectively form a first connecting side 42 and a second connecting side 43 opposing to each other. The first connecting sides 42 are respectively assembled to front sides of the left lens frame 20 and the right lens frame 21 and adjacent to the ring grooves 23. The second connecting sides 43 are respectively assembled to the left pad frame 50 and the right pad frame 51. The left connecting frame 40 and the right connecting frame 41 respectively form joint portions 44 on outward sides thereof. Each joint portion 44 (see FIG. 4) includes an arcuate recess 441 and a pit 442. The recess 441 is defined in a forward side of the joint portion 44 and adjacent to the first connecting side 42. The pit 442 is defined in a rearward side of the joint portion 44 and adjacent to the second connecting side 43. The recess 441 and a pit 442 absorb pulling force of a head strap being pulled. The joint portions 44 enhance bending of the left connecting frame 40 and the right connecting frame 41, making the left connecting frame 40 and the right connecting frame 41 touch a user's head closely, and preventing from leakage.

Figure 5:
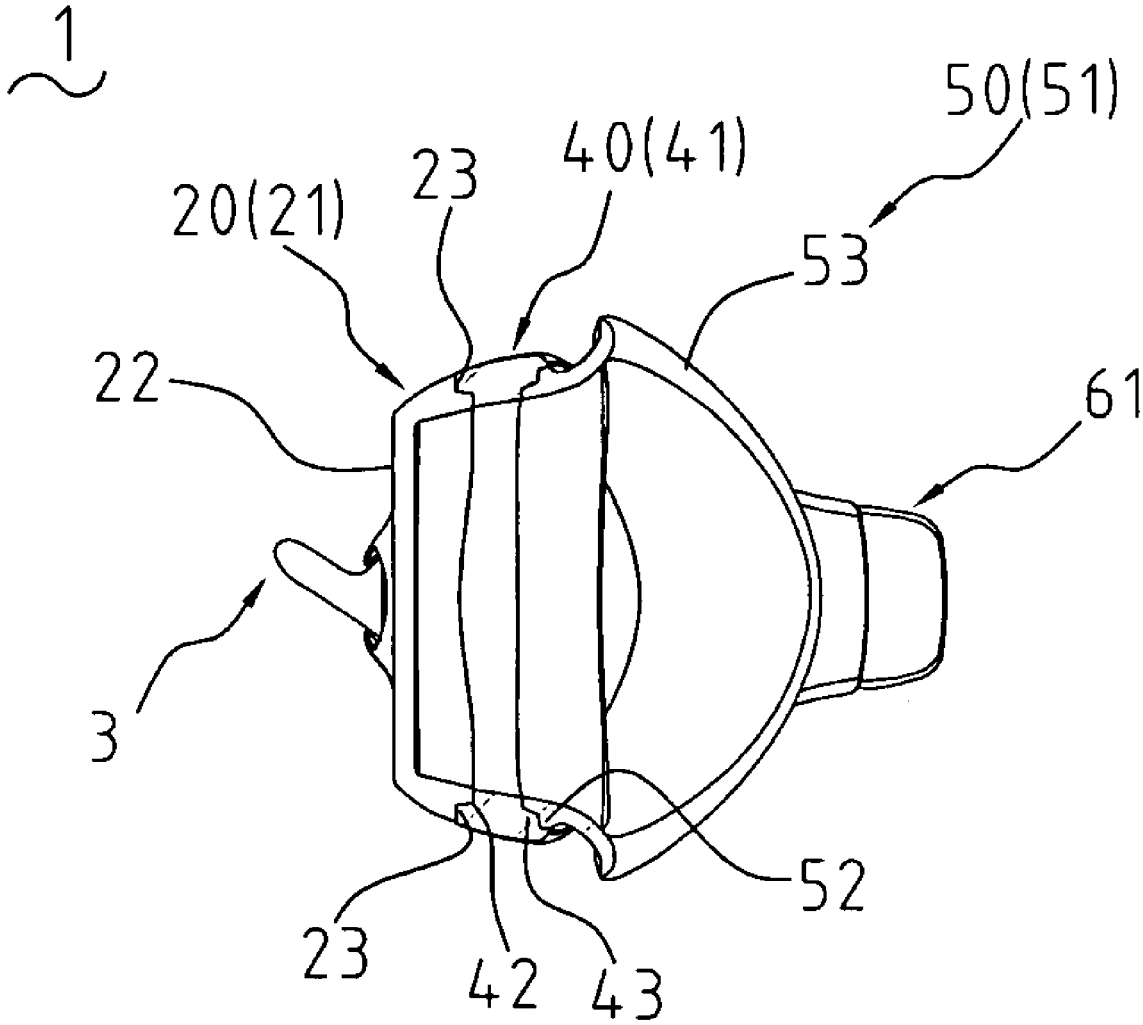
FIG. 5 is a cross-sectional view taken along the line 5-5 in FIG. 3.

The left pad frame 50 and the right pad frame 51 are both made of Thermoplastic Rubber (TPR), which is featured of injection shaping and gluing. The left pad frame 50 and the right pad frame 51 are softer than the left connecting frame 40 and the right connecting frame 41, and cover a user's eyeholes. Each of the left pad frame 50 and the right pad frame 51 includes an assembling side 52 and a touching side 53. The assembling sides 52 are unitarily formed with the second connecting sides 43, as shown in FIG. 5. Each assembling side 52 respectively forms an assembling flange 54 for assembling to the left connecting frame 40 and the right connecting frame 41 firmly. Nose pads 55 are respectively formed on inward sides of the left pad frame 50 and the right pad frame 51, and are integrally formed with the assembling sides 52. Each nose pad 55 extends from the second connecting side 43 of the left connecting frame 40/the right connecting frame 41 to the first connecting side 42, thereby fitting to a user's whole nose bridge tenderly when the swimming goggles 1 are worn.

The buckles 6 are made of Polycarbonate (PC), and are assembled on outward sides of the left connecting frame 40 and the right connecting frame 41. Each buckle 6 includes a branch 60 and an extending base 61 extending unitarily from the branch 60. The branches 60 extend along profiles of the left connecting frame 40 and the right connecting frame 41, and are embedded in the left connecting frame 40 and the right connecting frame 41. Each branch 60 defines a through hole 601 for filling stuffs while shaping, and for reinforcing assembly. The extending base 61 includes a guiding surface 610 and an arcuate surface 611. The guiding surface 610 extends to the branch 60 and fits to a profile of the left connecting frame 40/the right connecting frame 41. The arcuate surface 611 straddles the guiding surface 610 and the branch 60 for extending and fixing a head strap (not shown).

Figure 2:
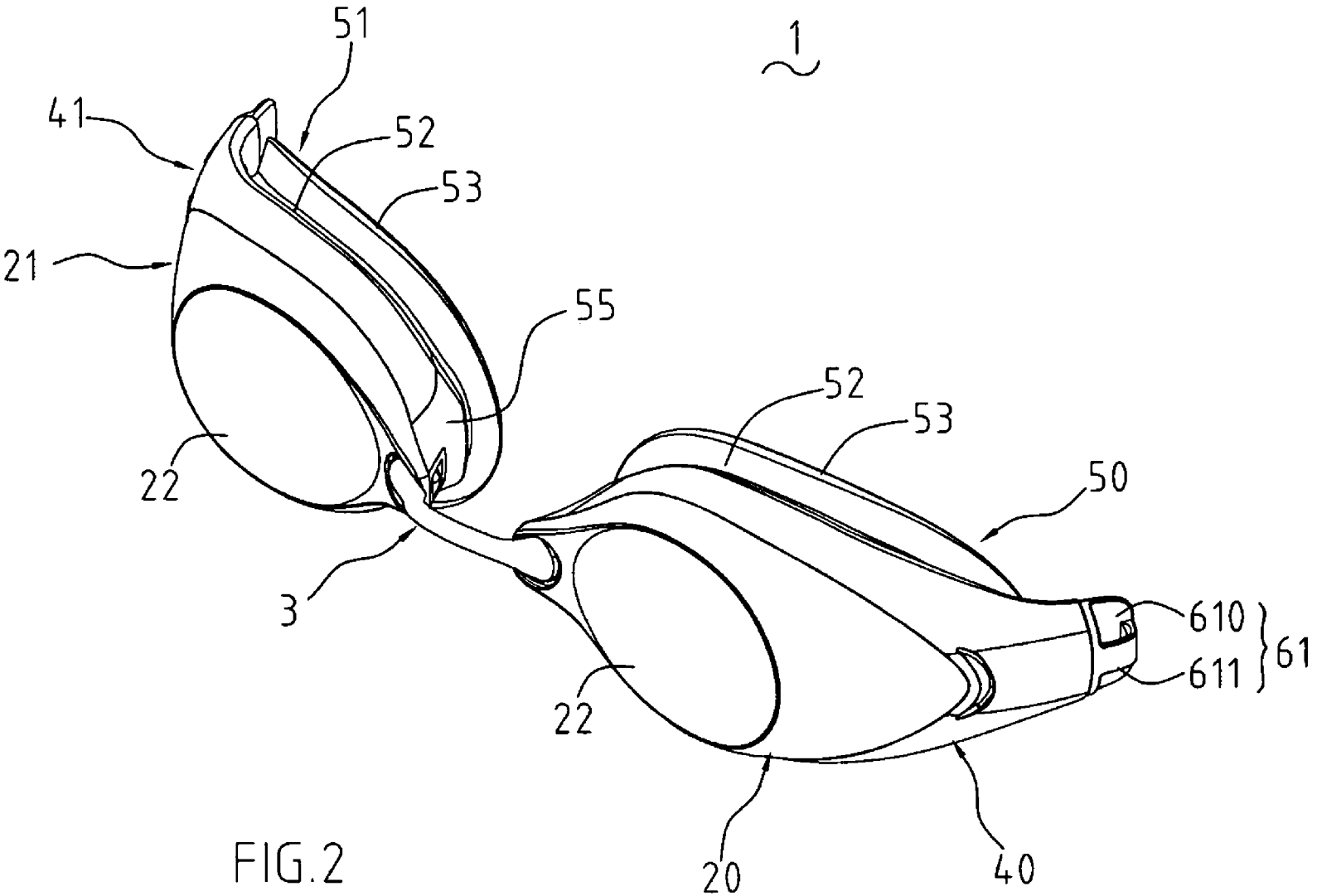
FIG. 2 is an assembled view of the swimming goggles of FIG. 1.

Referring to FIGS. 1 to 5, the swimming goggles 1 are assembled together by integral injection shaping. The ring grooves 23 and the assembling pegs 25 assemble the left connecting frame 40 and the right connecting frame 41 onto the left lens frame 20 and the right lens frame 21 reliably. The flanges 54 fix the left pad frame 50 and the right pad frame 51 onto the left connecting frame 40 and the right connecting frame 41. When having been shaped, as shown in FIG. 2, the swimming goggles 1 have three layers of material with different rigidity. The left lens frame 20 and the right lens frame 21 are the most rigid among the three layers. The left pad frame 50 and the right pad frame 51 are the most soft among the three layers. The left connecting frame 40 and the right connecting frame 41 have rigidity between the left lens frame 20/the right lens frame 21 and the left pad frame 50/the right pad frame 51. The touching sides 53 of the left pad frame 50 and the right pad frame 51 cover the user's eyeholes with soft material for providing comfort touching. The buckles 6 are assembled to the hard left connecting frame 40 and the hard right connecting frame 41. The joint portions 44 absorb and mitigate pulling force of the head strap. Thus, the left connecting frame 40 and the right connecting frame 41 are assembled to the left lens frame 20 and the right lens frame 21 firmly. The joint portions 44 provide bending flexibility for touching a user's head fittedly and prevents against leakage.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. Swimming goggles, adapted for fitting to users' eyeholes closely with low water resistance, comprising:

a left lens frame and a right lens frame, each of the left lens frame and the right lens frame having lens therein and defining a ring groove around the lens, assembling bases being formed on inward sides of the left lens frame and the right lens frame;

a connecting member being assembled on the assembling bases of the left lens frame and the right lens frame;

a left connecting frame and a right connecting frame being made of hard material resistable against pulling force from a head strap of swimming goggles, each of the left connecting frame and the right connecting frame forming a first connecting side and a second connecting side, the first connecting sides being respectively assembled to front sides of the left lens frame and the right lens frame and adjacent to the ring grooves;

a left pad frame and a right pad frame being made of material softer than the left connecting frame and the right connecting frame, and covering around a user's eyeholes, each of the left pad frame and the right pad frame including an assembling side and a touching side, the assembling sides being assembled with the second connecting sides of the left lens frame and the right lens frame; and buckles being assembled on outward sides of the left connecting frame and the right connecting frame, each buckle including a branch and an extending base extending unitarily from the branch, the branches being embedded in the left connecting frame and the right connecting frame.

2. The swimming goggles as claimed in claim 1, wherein assembling pegs are formed in the ring grooves and at outward sides of the left lens frame and the right lens frame opposite to the assembling bases for retaining the left connecting frame and the right connecting frame, each assembling peg including a base portion and a tail portion, majority of the base portions being integrated with the left lens frame and the right lens frame, the tail portion being shrouded by the left connecting frame and the right connecting frame when assembled.

3. The swimming goggles as claimed in claim 2, wherein the assembling bases define latch grooves therein, and wherein the connecting member is planar, and forms latch posts for latching the latch grooves of the assembling bases.

4. The swimming goggles as claimed in claim 3, wherein nose pads are respectively formed on inward sides of the left pad frame and the right pad frame, and are integrally formed with the assembling sides.

5. The swimming goggles as claimed in claim 4, wherein each of the nose pads extends from the second connecting side of the left connecting frame/the right connecting frame to the first connecting side.

6. The swimming goggles as claimed in claim 5, wherein each assembling side of the left pad frame and the right pad frame respectively forms an assembling flange thereon.

7. The swimming goggles as claimed in claim 6, wherein the left connecting frame and the right connecting frame respectively form joint portions on outward sides thereof, each joint portion including an arcuate recess in a forward side thereof and adjacent to an outward side of the first connecting side, and a pit in a rearward side of the joint portion and adjacent to the second connecting side.

8. The swimming goggles as claimed in claim 1, wherein the branches of the buckles extend along profiles of the left connecting frame and the right connecting frame, each branch defining a through hole for filling stuffs while shaping, and for reinforcing assembly.

9. The swimming goggles as claimed in claim 8, wherein the extending base of each buckle includes a guiding surface and an arcuate surface, the guiding surface extending to the branch and fitting to a profile of the left connecting frame/the right connecting frame, and the arcuate surface straddling the guiding surface and the branch.

10. The swimming goggles as claimed in claim 1, wherein the left lens frame, the right lens frame, the buckles and the connecting member are made of Polycarbonate (PC).

11. The swimming goggles as claimed in claim 1, wherein left connecting frame, the right connecting frame, the left pad frame and the right pad frame are made of Thermoplastic Rubber (TPR), which is featured of injection shaping and gluing.

* * * * *